US007699938B2

(12) United States Patent
Fujii et al.

(10) Patent No.: US 7,699,938 B2
(45) Date of Patent: Apr. 20, 2010

(54) CLEANING METHOD AND DISHWASHER USING SAME

(75) Inventors: Hiroyuki Fujii, Hyogo (JP); Yasuyuki Nukina, Osaka (JP); Yuko Omura, Kyoto (JP); Fumio Ota, Hyogo (JP)

(73) Assignee: Panasonic Corporation, Osaka (JP)

( * ) Notice: Subject to any disclaimer, the term of this patent is extended or adjusted under 35 U.S.C. 154(b) by 1023 days.

(21) Appl. No.: 11/097,269

(22) Filed: Apr. 4, 2005

(65) Prior Publication Data

US 2005/0224098 A1 Oct. 13, 2005

(30) Foreign Application Priority Data

Apr. 12, 2004 (JP) ..... 2004-116557

(51) Int. Cl.
*B08B 5/00* (2006.01)

(52) U.S. Cl. ..... 134/31; 134/25.2; 134/25.3

(58) Field of Classification Search ..... None
See application file for complete search history.

(56) References Cited

U.S. PATENT DOCUMENTS 5,485,828 A * 1/1996 Hauser ..... 128/200.16

FOREIGN PATENT DOCUMENTS

| | | | |
|---|---|---|---|
| DE | 199 40 645 | | 3/2001 |
| EP | 0 282 214 | | 9/1988 |
| EP | 0 465 454 | | 1/1992 |
| EP | 0 487 474 | | 5/1992 |
| EP | 1 042 983 | | 10/2000 |
| EP | 1 523 926 | A2 | 4/2005 |
| JP | 06182278 | A * | 7/1994 |
| JP | 11 346980 | | 12/1999 |
| JP | 2000-160645 | | 6/2000 |
| JP | 2000-189375 | | 7/2000 |
| JP | 2000-325282 | | 11/2000 |
| JP | 2000-325285 | | 11/2000 |
| KR | 20-1994-005065 | | 3/1994 |
| KR | 20-1998-018571 | | 7/1998 |
| WO | 98/17408 | | 4/1998 |
| WO | 02/04032 | | 1/2002 |
| WO | 02/31095 | | 4/2002 |

OTHER PUBLICATIONS

Derwent abstract of JP 2003-325285 retrieved Jan. 18, 2010.*

* cited by examiner

*Primary Examiner*—Michael Komakov
*Assistant Examiner*—Eric Golightly
(74) *Attorney, Agent, or Firm*—Bacon & Thomas, PLLC

(57) ABSTRACT

A cleaning method includes a first operation step of allowing a mist of a first cleaning fluid atomized in the order of microns to permeate into and remain in a food debris stuck on a to-be-cleaned item for a predetermined period of time; and a second operation step of removing the food debris on the to-be-cleaned item by using a second cleaning fluid. The second operation step is to be performed after the first operation step.

10 Claims, 9 Drawing Sheets

CLEANING METHOD AND DISHWASHER USING SAME

FIELD OF THE INVENTION

The present invention relates to a cleaning method for cleaning soiled items to be cleaned such as kitchen or dinning ware items and a dishwasher using same.

BACKGROUND OF THE INVENTION

A cleaning method for cleaning soiled items will be described for the case of a dishwasher for cleaning kitchen and dining ware items. As shown in FIG. 7, a conventional dishwasher employs a method of spraying water particles of wash water to items to be cleaned, e.g. dishware, in advance to make food debris stuck on the dishware fully swell and then removing the swollen food debris by using, for example, a mechanical power of jetting out wash water or chemical operations of detergent (see, for example, Japanese Patent Laid-open Application No. 2000-189375). Hereinbelow, a configuration of such a conventional dishwasher will be described. Main body 51 of the dishwasher includes therein washer tub 53 having a rack (not shown) for arranging dishware therein, and door 54 is provided at opening 52 of washer tub 53. Installed inside washer tub 53 are nozzle 55 for ejecting out wash water in washer tub 53 toward the dishware and spray arm 56 for generating water particles of the wash water in washer tub 53.

The operation of the dishwasher with the above-described configuration will now be explained. Further, cleaning operational mechanism of food debris stuck on the surface of, e.g., dishware will be described with reference to FIGS. 8A to 8C. First, after loading soiled dishware into the rack and loading detergent into the dishwasher, the operation of the dishwasher is initiated. Once the operation is started, wash water contained in washer tub 53 is sprayed by spray arm 56, as shown in FIG. 8A, to thereby produce water particles 57. Then, thus generated water particles 57 are dispersed into washer tub 53 to thereby make contact with food debris 59 stuck on the surface of dishware 58 and then permeate into food debris 59, as shown in FIG. 8B. Thereafter, as shown in FIG. 8C, food debris 59 gradually swells due to the permeation of water particles 57 thereinto. Particularly, in case the food debris are of water-soluble substances such as starch, the swelling degree of food debris 59 increases. Afterwards, a main washing for cleaning dishware 58 by using a cleaning fluid jetted out from nozzle 55 is performed. Here, the cleaning fluid refers to a solution containing detergent dissolved therein. The cleaning operational mechanism of the food debris stuck on the surface of the dishware during the main washing process will be described in conjunction with FIGS. 9A to 9C. Food debris 59 swollen in the pre-washing step are gradually washed away from dishware 58 by a great amount of wash water 60 sprayed from nozzle 55, as shown in FIGS. 9A to 9C. Upon the completion of the main washing process, a rinsing process is executed several times by replacing soiled wash water in washer tub 53 with fresh water. Then, by performing a warm-water rinsing process by using fresh warm water heated up to about 70° C., the cleaning of dishware 58 is finished. Finally, a drying process is executed to dry water drops on the dishware, and the operation of the dishwasher is terminated.

In the cleaning method of the conventional dishwasher, however, the pre-washing step is performed just by using tap water that contains no detergent component therein. Thus, though a certain degree of effect of swelling starch debris such as boiled rice may be obtained, improvement of cleaning performance in terms of stubborn protein or oil debris cannot be achieved.

SUMMARY OF THE INVENTION

It is, therefore, an object of the present invention to provide a cleaning method capable of remarkably improving cleaning performance by way of performing a pre-washing process for allowing a highly concentrated cleaning fluid containing a detergent component dissolved therein to coat and remain on food debris stuck on items to be cleaned in the form of mist to thereby make the food debris readily removable and then performing a main washing process by using a cleaning fluid.

In accordance with one aspect of the present invention, there is provided a cleaning method including: a first operation step of allowing a mist of a first cleaning fluid atomized in the order of microns to permeate into and remain in a food debris stuck on a to-be-cleaned item for a predetermined period of time; and a second operation step of removing the food debris on the to-be-cleaned item by using a second cleaning fluid, wherein the second operation step is to be performed after the first operation step.

In accordance with another aspect of the present invention, there is provided a dishwasher including a washer tub for accommodating therein a to-be-cleaned item and a wash nozzle for spraying a cleaning fluid to the to-be-cleaned item, wherein the dishwasher performs a first operation step of allowing a mist of a first cleaning fluid atomized in the order of microns to permeate into and remain in a food debris stuck on the to-be-cleaned item for a predetermined period of time; and a second operation step of removing the food debris on the to-be-cleaned item by using a second cleaning fluid, wherein the second operation step is to be performed after the first operation step.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

Hereinafter, a dishwasher for cleaning soiled dishware in accordance with preferred embodiments of the present invention will be described with reference to the accompanying drawings. Here, it is to be noted that the present invention is not limited thereto.

First Preferred Embodiment

Figure 1:
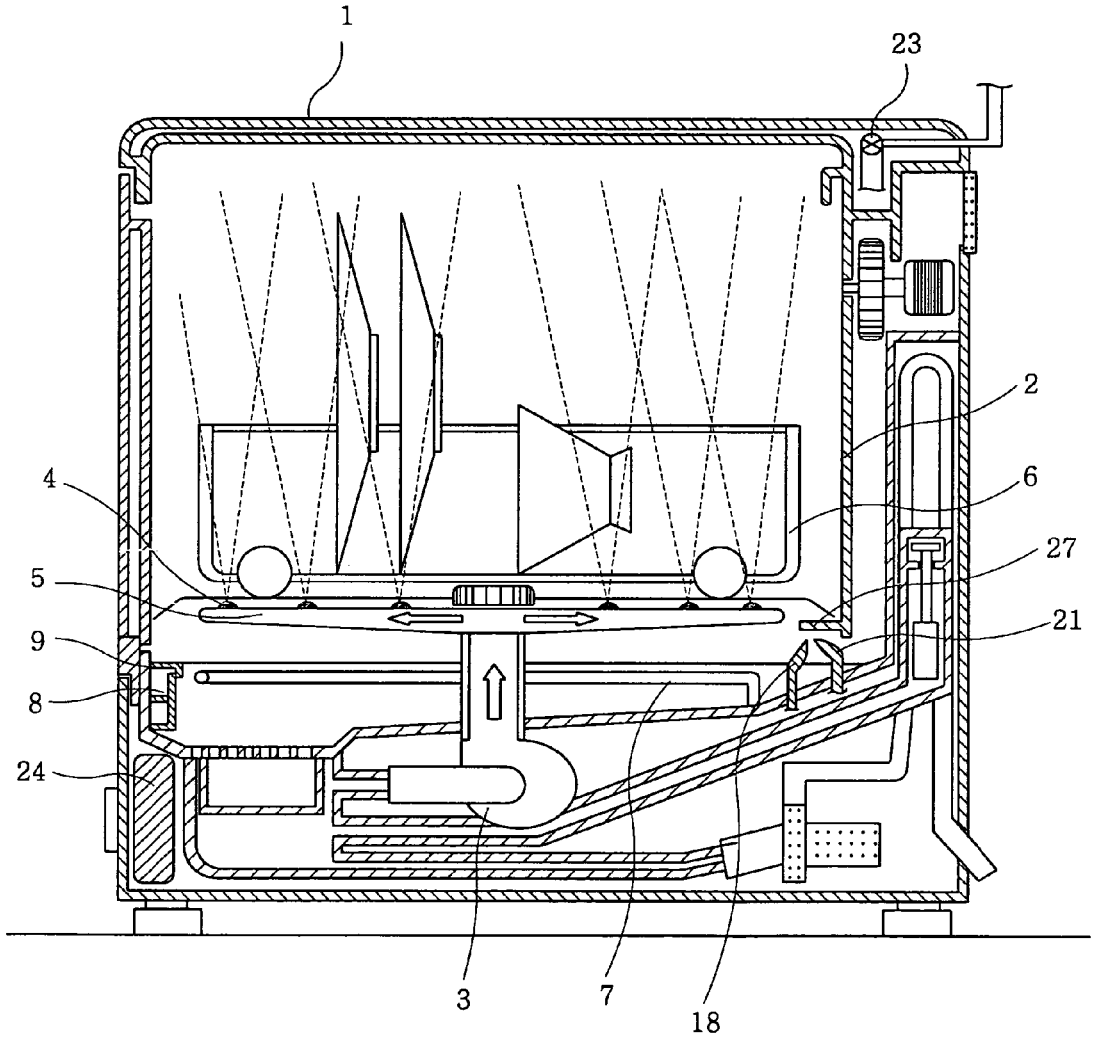
FIG. 1 is a cross sectional view of a dishwasher in accordance with a first preferred embodiment of the present invention.
Figure 2:
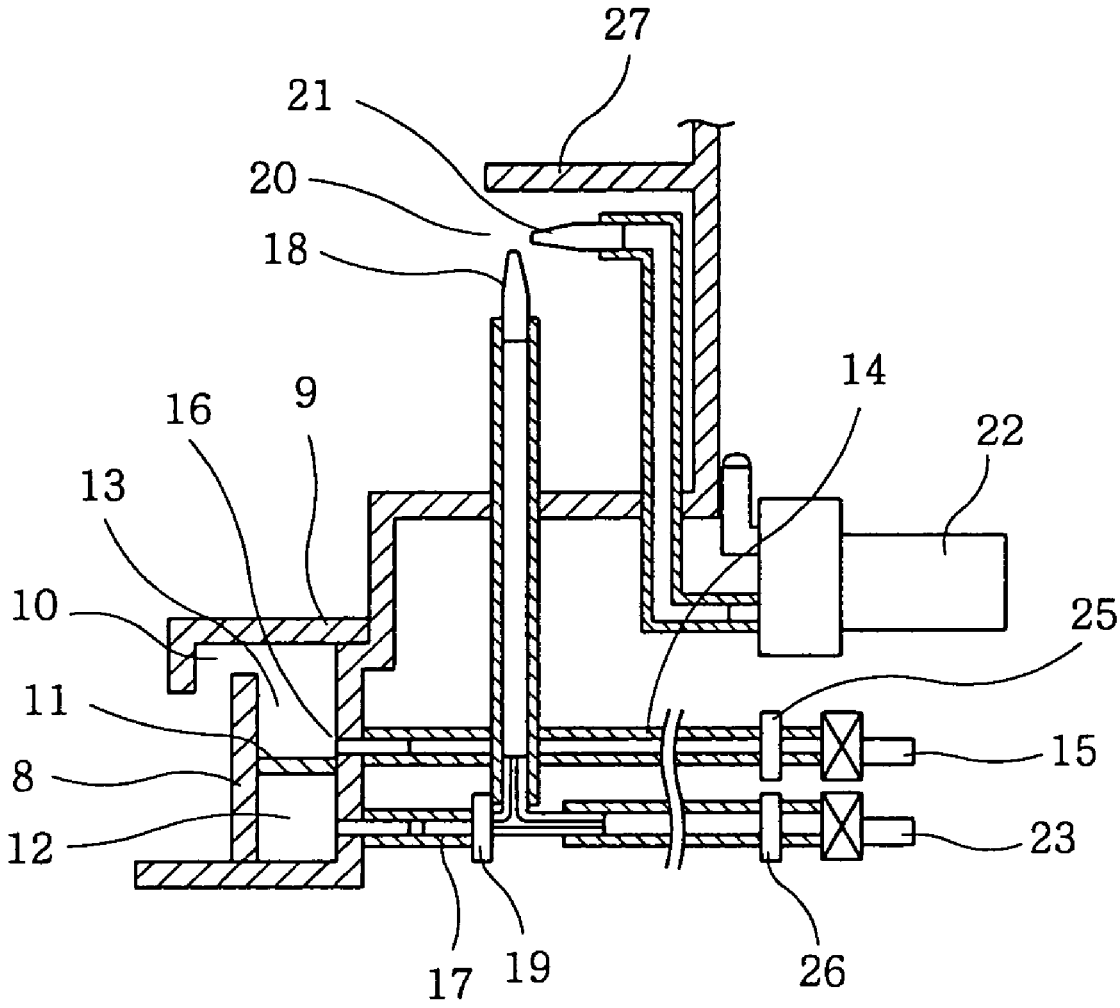
FIG. 2 presents a partial cross sectional schematic view showing a structure for generating and spraying a highly concentrated cleaning fluid for use in the dishwasher in the first embodiment of the present invention.

FIG. 1 is a cross sectional view of a dishwasher employing a cleaning method in accordance with a first preferred embodiment of the present invention and FIG. 2 sets forth a partial cross sectional schematic view of an atomizing unit for atomizing a cleaning fluid in the order of microns. Further, FIGS. 3A to 3D are drawings describing a process in which mist-like detergent solution atomized in the order of microns acts on soil, e.g., food debris, remaining on an item to be cleaned. As shown in FIG. 1, main body 1 of the dishwasher has washer tub 2 therein, and disposed underneath washer tub 2 is wash nozzle 5 having water jetting holes 4 for jetting out wash water which is pressurized by washing pump 3. Disposed above wash nozzle 5 is rack 6 for arranging therein items to be cleaned, e.g., dishware. Moreover, heater 7 for heating the wash water is disposed in a bottom portion of washer tub 2.

Detergent dispenser 8, which is provided with an opening capable of being opened or closed by lid 9 on a top surface thereof, is disposed in a front lower portion of washer tub 2. Further, water inlet 10 for supplying the wash water into washer tub 2 is provided at a lateral surface of detergent dispenser 8. The inside of detergent dispenser 8 is divided into an upper and a lower portion by the presence of filter 11 provided with multiple holes on its surface. Filter 11 has an opening area adequate for allowing a detergent powder dissolved in wash water to flow down into lower portion 12 as a detergent solution.

Formed at a sidewall of upper portion 13 of detergent dispenser 8 is discharge hole 16 communicating with first water supply valve 15 via dissolution path 14. Detergent is dissolved by a discharge force of the wash water discharged from discharge hole 16, and flows down into lower portion 12 of detergent dispenser 8 through filter 11 to be stored therein. A sidewall of lower portion 12 is opened, thus allowing lower portion 12 to communicate with detergent solution jetting nozzle 18 via injection path 17. Further, reference numeral 19 is assigned to a flow control valve installed in injection path 17 to control a flow rate of the detergent solution jetted out from detergent solution jetting nozzle 18.

Spray nozzle unit 20 for spraying the detergent solution toward the dishware is disposed in a lower portion of washer tub 2. Spray nozzle unit 20 includes aforementioned detergent solution jetting nozzle 18 and air jetting nozzle 21. Air pressurized by air pump 22 is jetted out from jetting nozzle 21 toward the dishware in a direction substantially perpendicular to a jetting out direction of detergent solution jetting nozzle 18. Further, disposed in injection path 17 through which detergent solution spray nozzle 18 communicates with detergent dispenser 8 is second water supply valve 23 for supplying water into washer tub 2.

Air pump 22 has a driving source for varying a jetting pressure of air, and controller 24 controls air pump 22 and also washing pump 3, heater 7, first water supply valve 15, second water supply valve 23, and so forth. Back stream prevention valves 25 and 26 are installed in dissolution path 14 and injection path 17, respectively, in order to prevent soiled wash water from flowing back into first water supply valve 15 and second water supply valve 23, respectively. Spray nozzle unit 20 is covered with protection cover 27 to prevent food debris from being deposited on spray nozzle unit 20 when the dishware is loaded into the dishwasher or during a cleaning process of the dishware.

Further, if a DC motor is used as the driving source of air pump 22, it is possible to vary the jetting out pressure of air by controlling a current applied to the motor. If the driving source of air pump 22 is an AC motor, on the other hand, the jetting out pressure of air can be varied by controlling a driving frequency of the driving source of air pump 22. Moreover, detergent solution jetting nozzle 18, air pump 22, air jetting nozzle 21 and controller 24 jointly form a detergent solution spray unit.

In addition, detergent dispenser 8, lid 9, filter 11, first water supply valve 15, dissolution path 14 and injection path 17 jointly function as a detergent solution generating unit. Also, first water supply valve 15, discharge hole 16 and controller 24 form a concentration control unit together.

Hereinafter, the operation of the dishwasher with the above-described configuration and cleaning operational mechanism obtained thereby will be described with reference to FIGS. 3A to 3D. First, a first cleaning operation is performed. A predetermined quantity of detergent (powder detergent) is added into detergent dispenser 8 through opening lid 9 installed at the top portion of detergent dispenser 8 such that the detergent is set on filter 11 of detergent dispenser 8. Water from first water supply valve 15 flows through dissolution path 14 and is supplied into upper portion 13 of detergent dispenser 8 through discharge hole 16 opened at the sidewall of filter 11. At this time, the detergent is dissolved in the water while being swept away by a water current during the supply of water and then flows down into lower portion 12 of detergent dispenser 8 through the holes in filter 11 to be stored therein as a detergent solution.

Moreover, in case the amount of water supplied in detergent dispenser 8 is set to be smaller than that for use in a typical dishwashing process, it becomes possible to obtain a highly concentrated detergent solution. For example, in case of adding a predetermined quantity of detergent, by setting the amount of water to be equivalent to only 1/50 of that for use in the typical dishwashing process, a 50 times higher concentration of detergent solution can be obtained. First water supply valve 15 is used to produce the highly concentrated detergent solution by dissolving the detergent in a small amount of tap water. Thus, a water valve with a low flow rate is used as first water supply valve 15.

Thereafter, when air pump 22 is operated, air is ejected out from air jetting nozzle 21 at a high speed, so that the air pressure along the ejected air direction as well as around the path of detergent solution jetting nozzle 18 located at a vicinity of air jetting nozzle 21 in a vertical direction thereto becomes a negative pressure due to an ejector effect. As a consequence, the detergent solution collected in lower portion 12 of detergent dispenser 8 is suctioned into detergent solution jetting nozzle 18 via injection path 17. Then, the detergent solution is atomized into fine mist-like detergent solution 28, which is a first cleaning fluid, by the air jetted out from air jetting nozzle 21 to be sprayed toward the inside of washer tub 2.

Figure 3A:
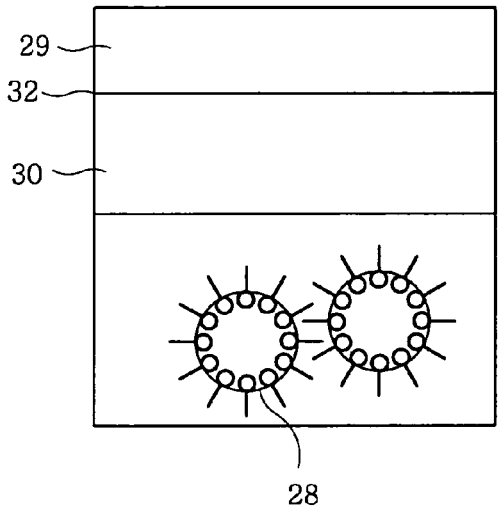
FIGS. 3A to 3D provide drawings describing cleaning operational mechanism in a cleaning method of the first embodiment of the present invention.
Figure 3B:
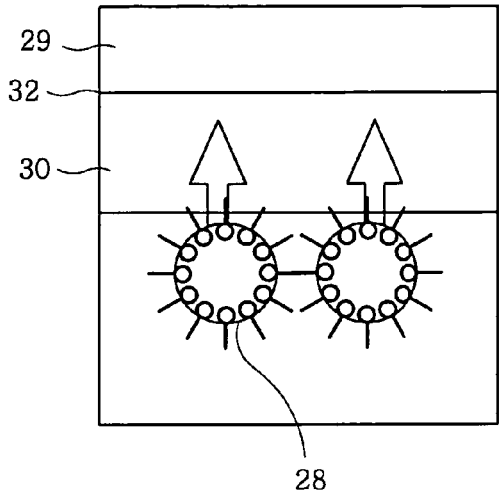
Figure 3C:
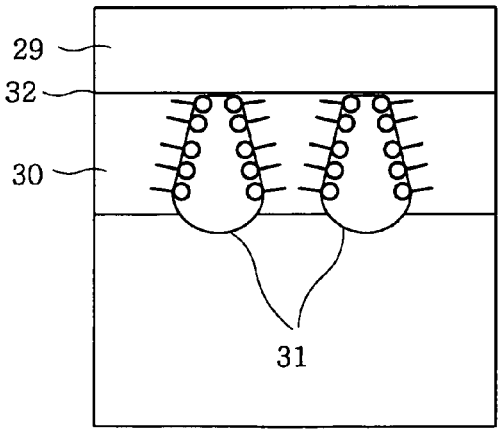
Figure 3D:
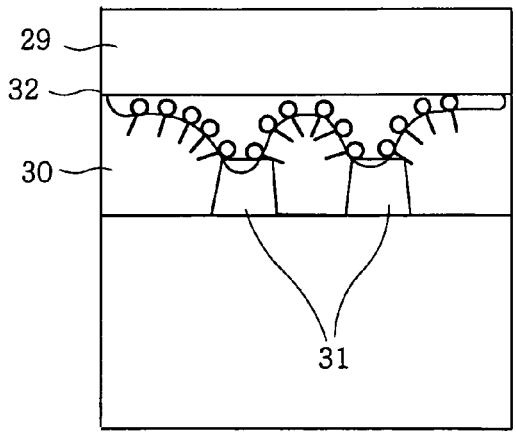

As shown in FIG. 3A, mist-like detergent solution 28, i.e., detergent vapor in a form of mist, generated by detergent solution jetting nozzle 18 retains therein a pressure energy obtained when it is atomized, and is sprayed into washer tub 2 to make a contact with dishware 29 arranged in washer tub 2. Further, since the pressure energy accumulated in the mist-like detergent solution 28 increases as its droplet diameter decreases, the droplet diameter of mist-like detergent solution 28 is set to be in the order of microns to increase the effectiveness thereof. Food debris 30 is stuck on the surface of dishware 29. As shown in FIG. 3B, when mist-like detergent solution 28 makes contact with food debris 30 on the surface of dishware 29, it emits its internal pressure energy toward the contact surface with food debris 30. As illustrated in FIG. 3C, when mist-like detergent solution 28 emits its internal pressure energy toward food debris 30, it injects a detergent component contained therein into the inside of the food debris. At this time, if mist-like detergent solution 28 contains therein a permeable component such as an alkaline agent, the detergent component would permeate into the food debris deeply, forming holes 31 therein, as shown in FIG. 3C. Further, in case mist-like detergent solution 28 contains a surfactant therein, the surfactant would permeate into interface 32 between dishware 29 and food debris 30 more deeply, thereby separating food debris 30 from the surface of dishware 29, as shown in FIG. 3D. Preferably, mist-like detergent solution 28 is obtained by dissolving detergent capable of removing food debris from dishware (for example, at least one of an alkaline agent, a surfactant, an enzyme and a bleaching agent) in wash water in accordance with the present invention. Moreover, the effect of separating food debris 30 from the surface of dishware 29 is enhanced as time elapses and the concentration of the cleaning component increases. Accordingly, in order to obtain a stronger separating effect, it is preferable to allow mist-like detergent solution 28 to coat and then remain on food debris 30 for a predetermined period of time.

Due to the permeation and separation function of mist-like detergent solution 28, coherence between dishware 29 and food debris 30 is considerably reduced, so that it becomes much easier to remove food debris 30 from the surface of dishware 29.

Next, a second cleaning operation follows the first cleaning operation described so far. First, second water supply valve 23 is opened, and some of thus supplied tap water flows into lower portion 12 of detergent dispenser 8 and is fed into washer tub 2 through water inlet 10 of upper portion 13 while dissolving therein detergent residues remaining on filter 11 and rinsing the inside of detergent dispenser 8. Further, the rest of the tap water is sprayed into washer tub 2 from detergent solution jetting nozzle 18 while flowing through injection path 17. Thus, in the water supply process of the second cleaning operation performed after the completion of the first cleaning operation, the detergent solution inside injection path 17 and detergent solution jetting nozzle 18 is completely washed away by the tap water, and, thus, deposition of detergent components in those paths is prevented, thereby ensuring wash water to be sprayed stably.

Figure 4A:
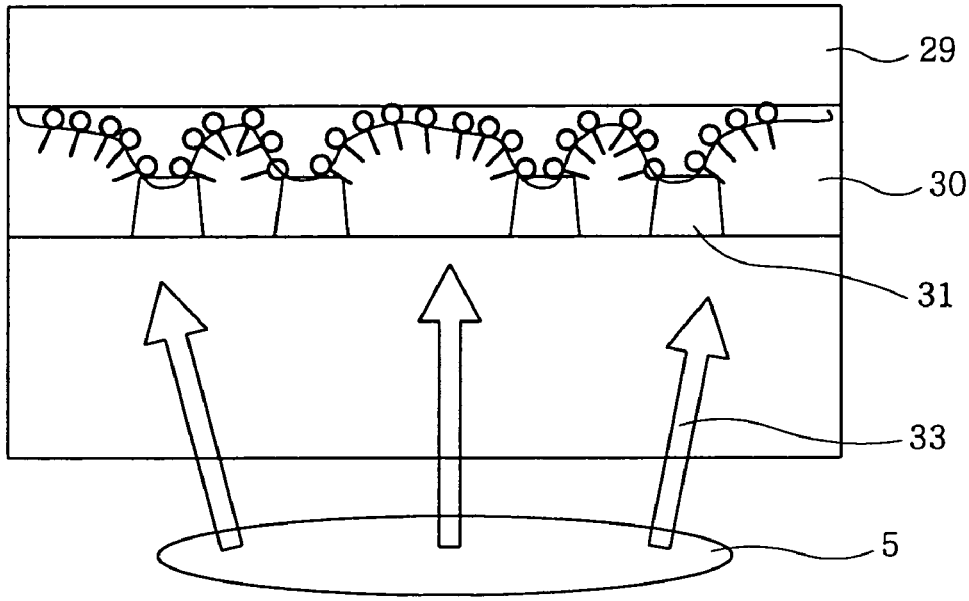
FIGS. 4A and 4B offer drawings further describing the cleaning operational mechanism in the cleaning method of the first embodiment of the present invention.
Figure 4B:
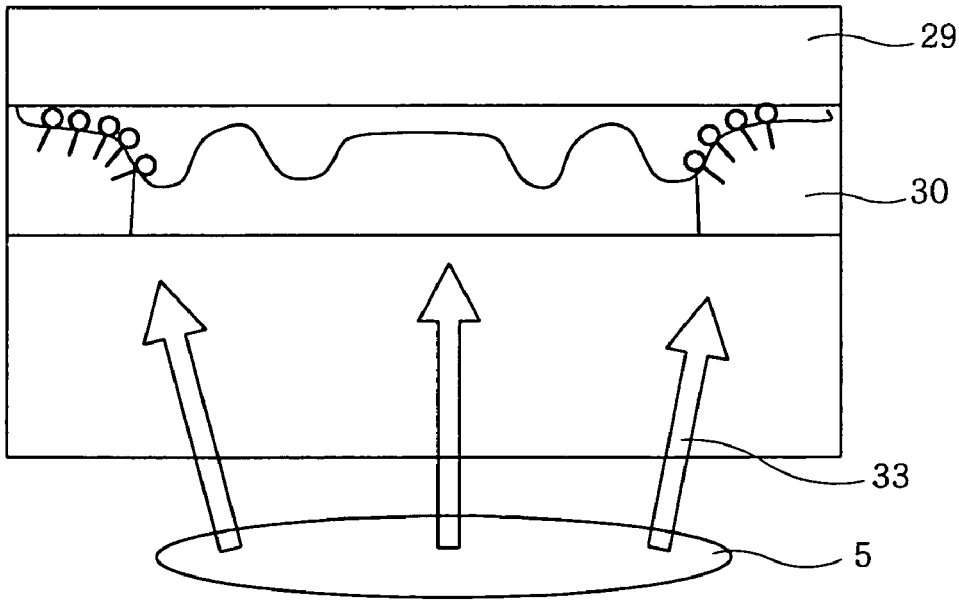

Then, if a water level detecting float (not shown) detects a predetermined amount of water stored in washer tub 2, washing pump 3 is driven to spray the wash water to dishware from wash nozzle 5. Further, as for the detergent amount, since most of the firstly loaded detergent is sprayed onto dishware during the first cleaning operation and the residues of the detergent are also added into washer tub 2 during the first water supplying step of the second cleaning operation, the cleaning operation of the dishwasher can be performed by using the whole amount of detergent originally loaded into detergent dispenser 8. FIGS. 4A and 4B describe cleaning operational mechanism during the second cleaning operation. As shown in FIG. 4A, second cleaning fluid 33 is sprayed onto the surface of dishware 29 from wash nozzle 5. Since the food debris stuck on the surface of dishware 29 is being separated therefrom by mist-like detergent solution 28 supplied during the first cleaning operation, the food debris can be readily removed from the surface of dishware 29, as shown in FIG. 4B.

Then, after performing a rinsing process several times by replacing soiled wash water in washer tub 2 with fresh water, a warm-water rinsing process using fresh warm water is performed, and the cleaning operation is completed. Further, a drying process for drying the cleaned dishware can be additionally performed.

As described, in accordance with the first embodiment of the present invention, there is performed a first cleaning operation in which mist of a detergent solution of a concentration higher than that for use in a typical dishwashing process is generated by using air jetting nozzle 21, and thus generated mist of detergent solution is made to coat and remain on items to be washed for a predetermined period of time. By performing such a first cleaning operation, food debris stuck on the items to be washed can be separated therefrom. Further, by performing a second cleaning operation for removing thus separated food debris after the first cleaning operation, cleaning performance can be improved remarkably. Moreover, with this improved cleaning performance, it becomes possible to shorten a cleaning time or reduce a cleaning temperature. Also, food debris once hardly removable can be washed away easily.

Second Preferred Embodiment

Figure 5:
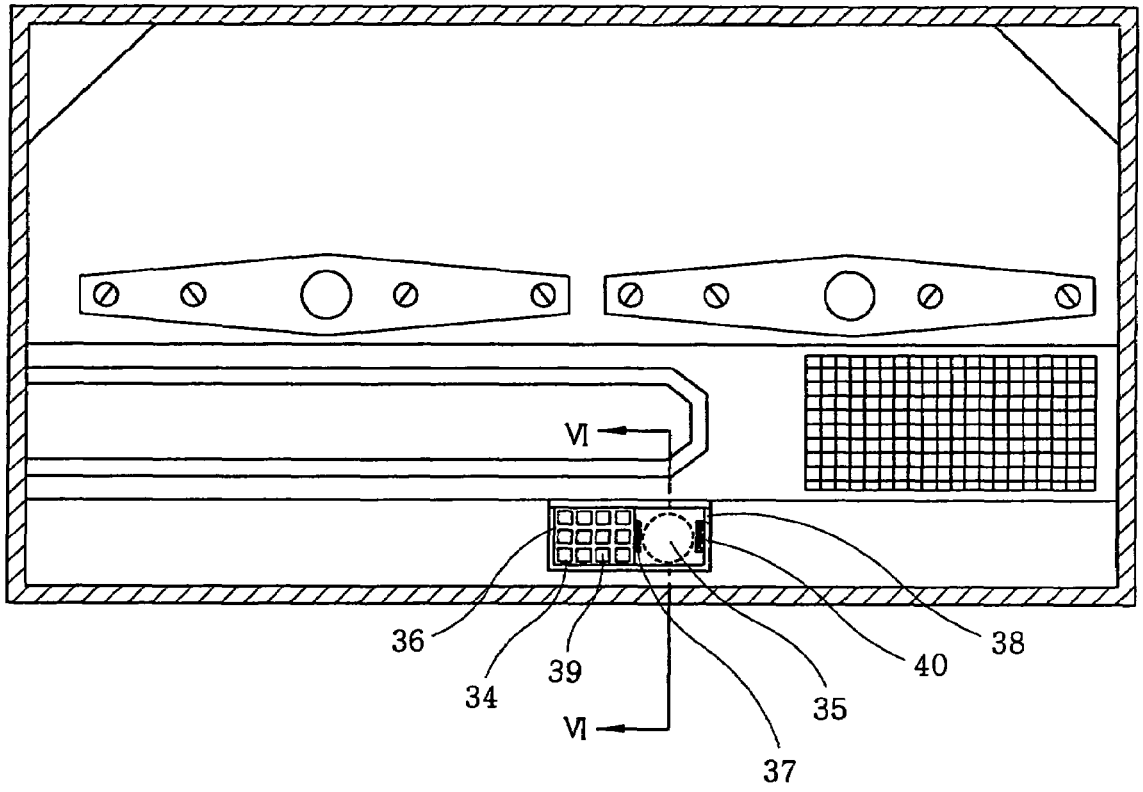
FIG. 5 sets forth a cross sectional view showing major components of a washer tub for use in a dishwasher in accordance with a second preferred embodiment of the present invention.
Figure 6:
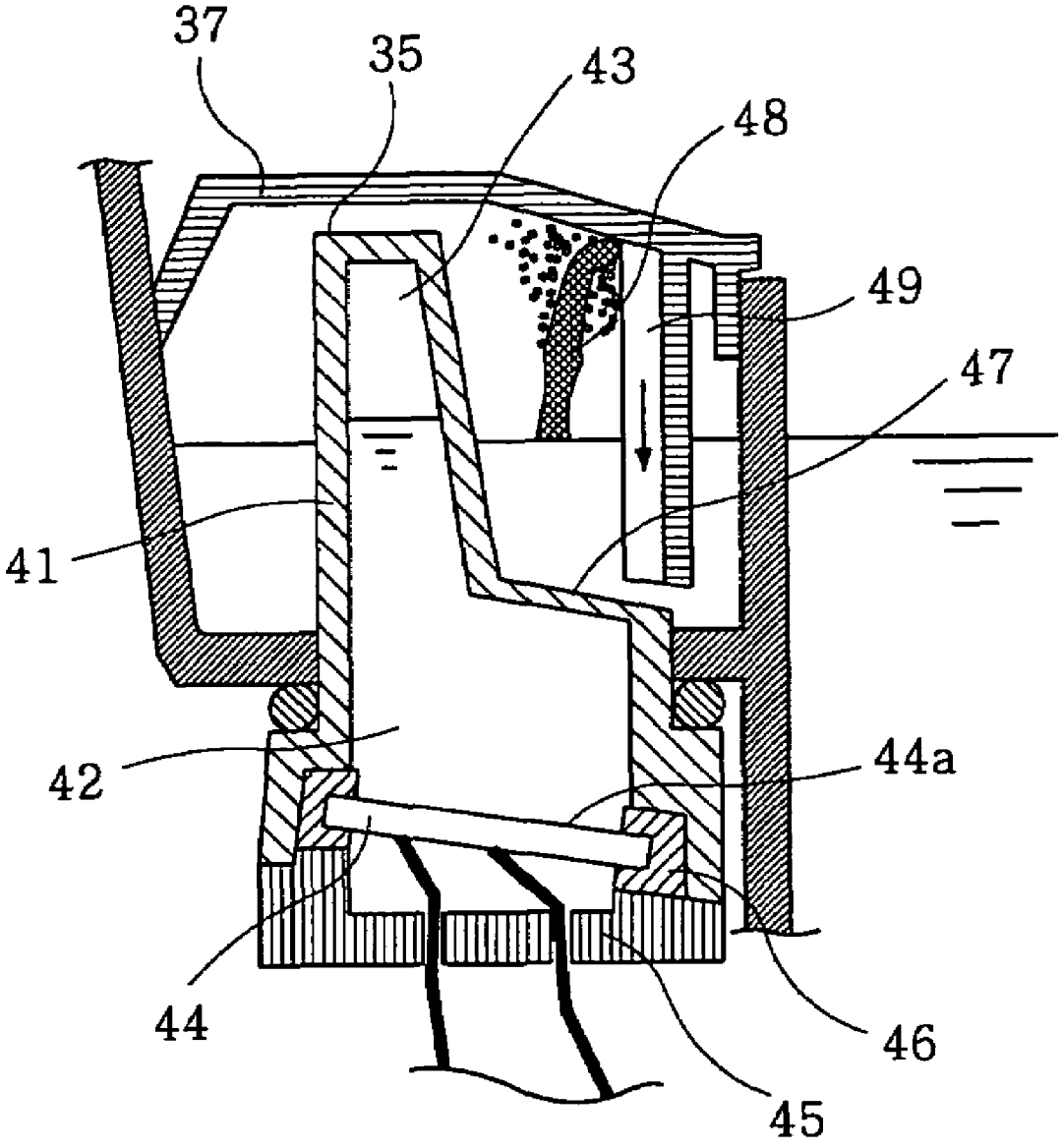
FIG. 6 shows a cross section of an atomizing unit for use in the dishwasher in accordance with the second embodiment of the present invention.
Figure 7:
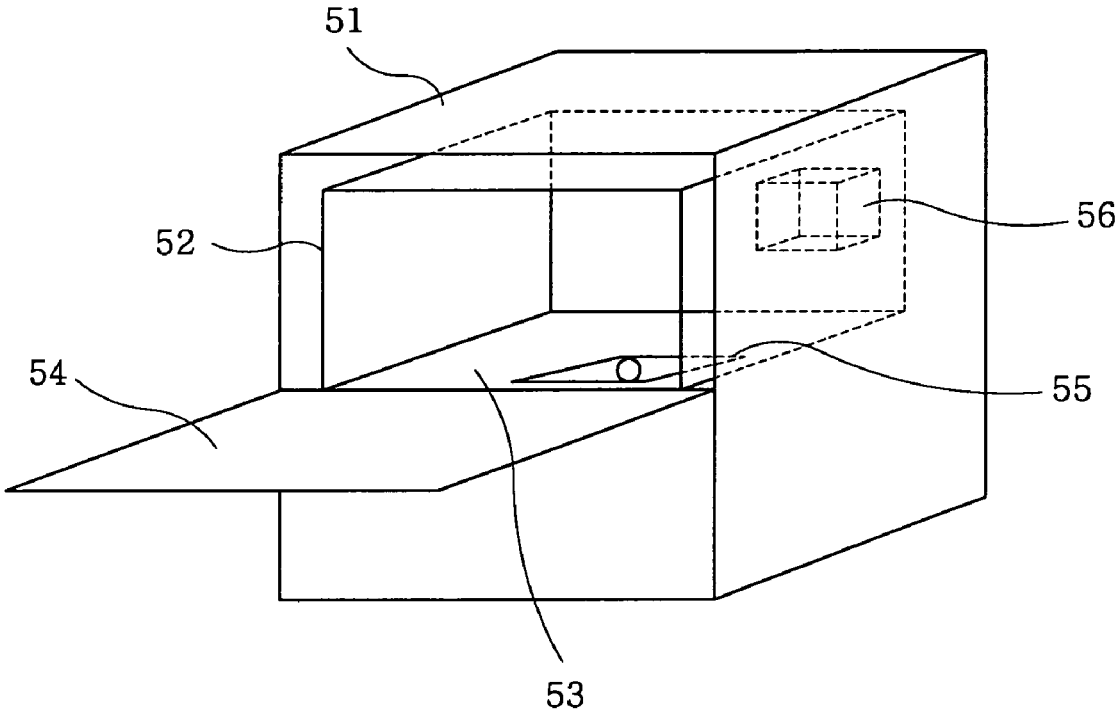
FIG. 7 (PRIOR ART)
FIG. 7 is a side cross sectional view of a conventional dishwasher.
Figure 8A:
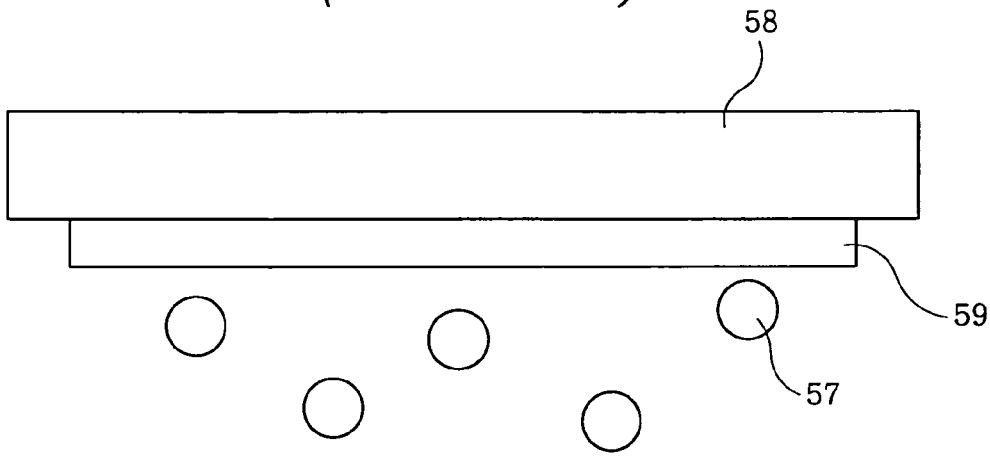
FIG.8A (PRIOR ART)
FIGS. 8A to 8C provide drawings describing cleaning operational mechanism in a conventional cleaning method.
Figure 8B:
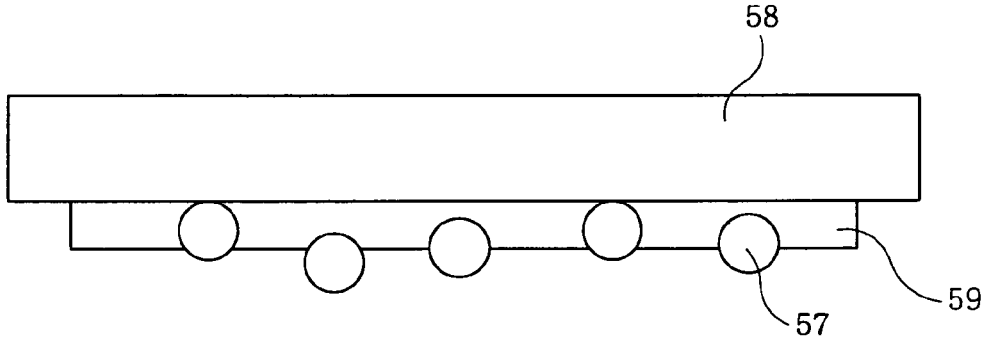
FIG.8B (PRIOR ART)
Figure 8C:
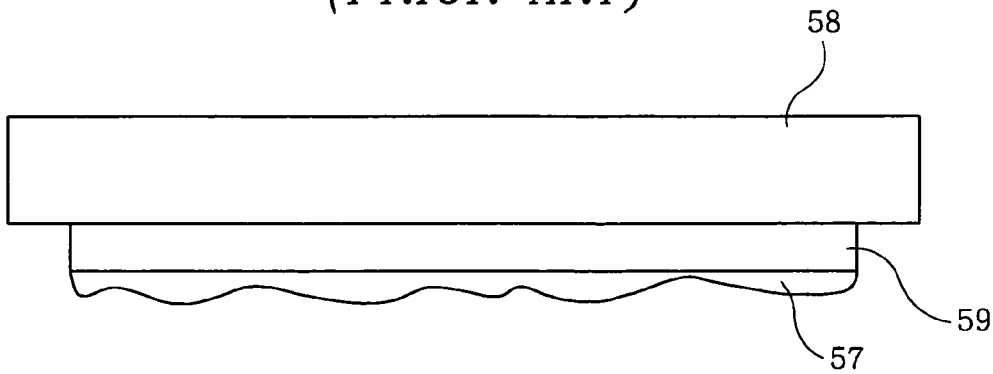
FIG.8C (PRIOR ART)
Figure 9A:
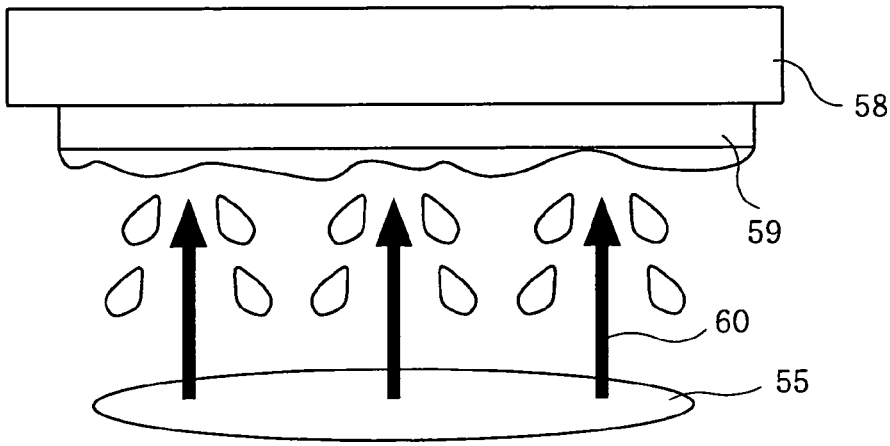
FIG. 9A (PRIOR ART)
FIGS. 9A to 9C set forth drawings further describing the cleaning operational mechanism in the conventional cleaning method.
Figure 9B:
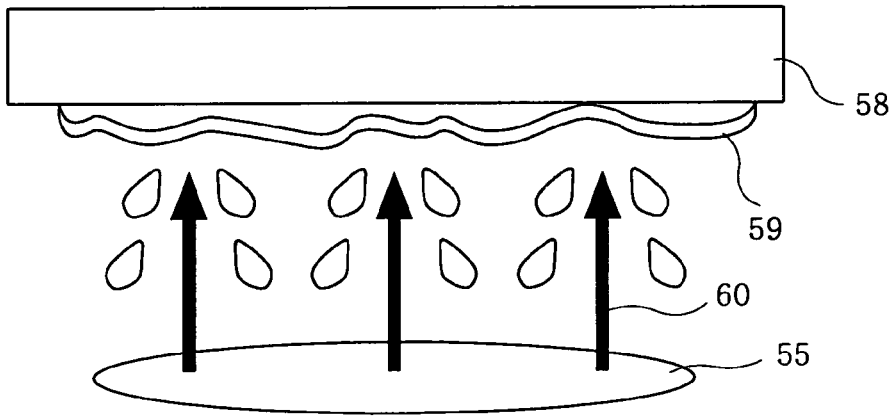
FIG. 9B (PRIOR ART)
Figure 9C:
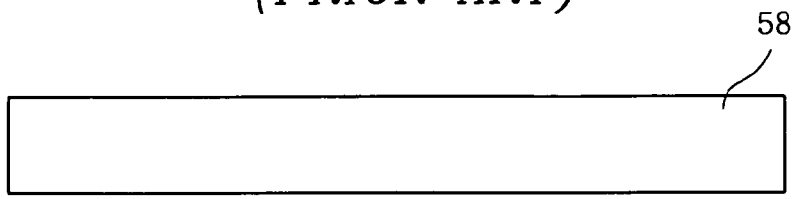
FIG. 9C (PRIOR ART)

FIG. 5 is a cross sectional view showing major components of a washer tub for use in a dishwasher in accordance with a second preferred embodiment of the present invention and FIG. 6 is a partial cross sectional view (taken along the line VI-VI in FIG. 5) of an atomizing unit for atomizing a detergent solution during the first cleaning operation. Parts or structures identical to those described in the first preferred embodiment will be assigned like reference numerals, and description thereof will be omitted. As shown in FIG. 5, detergent solution generating unit 34 is installed at a front lower portion of washer tub 2 of the dishwasher. Specifically, detergent solution generating unit 34 is formed as a tub independent of washer tub 2 and includes therein atomizing unit 35 and detergent storage unit 36. Further, detergent solution generating unit 34 whose top portion is closed by detergent loading cover 37 communicates with washer tub 2 through cutoff portion 38 formed in detergent loading cover 37.

Detergent loading cover 37 is provided with top opening 39 at a position approximately above detergent storage unit 36, wherein detergent is loaded into detergent storage unit 36 through top opening 39. Further, atomized mist-like detergent solution 28 is dispersed into washer tub 2 through side opening 40 provided at a side surface of detergent loading cover 37. In addition, as shown in FIG. 6, atomizing unit 35 includes sealed vessel 41 containing therein fluid medium 42 and air 43, and ultrasonic vibrator 44 is installed at the bottom of vessel 41 such that fluid medium 42 rests on vibrating surface 44*a* of ultrasonic vibrator 44. Further, by making lid 45 in pressurized contact with packing 46 installed at ultrasonic vibrator 44, vessel 41 is sealed and ultrasonic vibrator 44 is completely isolated from wash water in washer tub 2. Moreover, vibrating surface 44*a* of ultrasonic vibrator 44 is installed to be substantially parallel to interface (inclined surface) 47 of vessel 41, while forming a small angle of inclination with respect to the surface of the wash water in washer tub 2.

The operation of the dishwasher having the above-described configuration will be described. As described above, atomizing unit 35 used in the cleaning method of the present invention includes sealed vessel 41 containing fluid medium 42 on the side of vibrating surface 44*a* of ultrasonic vibrator 44, and ultrasonic vibrator 44 is completely isolated from the wash water. That is, since ultrasonic vibrator 44 is prevented from making contact with soiled wash water in case of operating the dishwasher, food debris in the form of sludge is prevented from being deposited and hardened on vibrating surface 44*a* of ultrasonic vibrator 44. Further, in case of using hard water such as well water, mineral dissolved in the hard water can also be prevented from being deposited on the vibrating surface 44*a* of ultrasonic vibrator 44, so that mist generation can be stably carried out for an extended period of time.

Next, the cleaning method of the dishwasher in accordance with the second preferred embodiment of the present invention will be described. First, a predetermined amount of detergent is loaded into detergent storage unit 36, and a preset amount of wash water is supplied through a water supply valve (not shown). At this time, the water level in washer tub 2 is set and regulated by controller 24 to be maintained above interface 47. The wash water flows into detergent solution generating unit 34 through cutoff portion 38, so that some of the detergent in detergent storage unit 36 is dissolved in the wash water. If ultrasonic vibrator 44 starts to be operated at the moment, vibrations generated therefrom are transmitted to interface 47 through fluid medium 42 and then is transmitted to the wash water via interface 47. As a result, water column 48 is generated on the surface of the wash water, and atomization of cleaning fluid is performed from water column 48.

In order to obtain stable cleaning performance with mist-like detergent solution 28, which is the first cleaning fluid, produced by atomization of the detergent solution, it is required to efficiently dissolve the detergent loaded in the wash water and to prevent a dispersion of thus obtained detergent solution into the wash water in the washer tub 2, to thereby prevent any decrease in detergent concentration. For the purpose, return passage 49 is formed in an inner wall of detergent loading cover 37 to collect water column 48 of detergent solution in detergent storage unit 36, thereby preventing a leakage of highly concentrated detergent solution into washer tub 2. Return passage 49 is formed downward from a top portion of detergent loading cover 37, and its cross section is formed in an approximately one-side opened rectangular shape, wherein the highly concentrated detergent solution flows therethrough as shown by an arrow in FIG. 6.

In the one with the above structure, a water current of detergent solution is generated inside detergent solution generating unit 34, thus facilitating the dissolution of detergent. Further, the above structure also serves to prevent a reduction of detergent concentration. Moreover, since the wash water is heated by supplying power to heater 7 during the atomization process, the dissolution of detergent can be further facilitated, resulting in an increase in detergent concentration. As such, the concentration of the highly concentrated detergent solution increases as the spray of detergent solution is continued.

Moreover, though the highly concentrated detergent solution may be leaked from cutoff portion 38 into washer tub 2, a decrease in the detergent concentration can be minimized because the opening area of cutoff portion 38 has already been minimized in this preferred embodiment. Furthermore, since the generation of particulate mist-like detergent solutions is stopped and thus there will be no more spray of detergent solutions when the water level in washer tub 2 falls below interface 47, controller 24 controls the water supply valve such that the water level in washer tub 2 is always maintained above interface 47 while ultrasonic vibrator 44 is being operated.

In addition, by optimizing a distance or a relative angle between interface 47 and vibrating surface 44*a*, a distance between interface 47 and the surface of the wash water, and the like, the efficiency of generating mist-like detergent solution 28 can be improved. Further, in case air bubbles are gathered at the inner wall of interface 47, they would obstruct the transmission of vibration from ultrasonic vibrator 44 to interface 47. Therefore, interface 47 in accordance with the present invention is made to be inclined so that the air bubbles are directed to move along the inclined interface 47 to thereby stay away from the center of vibration.

Though an atomized mist-like detergent solution 28 has a fine droplet diameter, it merely lingers on the surface of wash water without any upward convection into the upper portion of washer tub 2. However, by supplying power to heater 7 (circulation mechanism) during the atomization process in accordance with the second embodiment of the present invention, the wash water is heated and convection of air occurs due to heat accompanied with a rise in temperature. Moreover, mist-like detergent solution 28, being carried along by a rising current of air, would rise filling washer tub 2 to completely coat the surface of dishware. Also, by increasing the temperature of the atomized detergent solution in the previous step, chemical components in the cleaning fluid are further activated, resulting in a remarkable improvement of cleaning performance.

As for a cleaning operation of the second preferred embodiment, it is identical to that of the first preferred embodiment, and description thereof will be omitted. As described above, by performing a first cleaning operation for atomizing a detergent solution by means of atomizing unit 35 and allowing thus atomized detergent to coat and remain on items to be cleaned and to be maintained thereon for a predetermined period of time, cleaning performance can be improved considerably.

In the cleaning method in accordance with the present invention described above, a mist-like cleaning fluid atomized in the order of microns is allowed to permeate into and remain in food debris stuck on the items to be washed in advance. Then, after the lapse of a predetermined period of time, a cleaning operation is performed by using a second cleaning fluid, thereby obtaining remarkably improved cleaning performance. Thus, the present invention can be applied to a washing machine, a hand washer, a skin care device, and the like, in addition to the dishwasher.

By using the cleaning method of the present invention, the cleaning performance of removing food debris, e.g., oil debris, hardly removable, can be improved considerably.

While the invention has been shown and described with respect to the preferred embodiments, it will be understood by those skilled in the art that various changes and modifications may be made without departing from the spirit and scope of the invention as defined in the following claims.

What is claimed is:

1. A method for cleaning a to-be-cleaned item accommodated in a washer tub of a dishwasher, the dishwasher including a water nozzle for spraying fluid to the to-be-cleaned item; a detergent solution generating unit, which communicates with the washer tub to provide a concentrated detergent solution;

an ultrasonic vibrating unit for atomizing the detergent solution to generate a first cleaning fluid in a form of a mist; and a detergent loading cover for closing a top portion of the detergent solution generating unit, the cleaning method comprising:

a first operation step which includes supplying a wash water into the detergent solution generating unit containing a detergent composition to generate an aqueous detergent solution as a column by an ultrasonic vibrating unit and to atomize a portion of the aqueous detergent solution in the order of microns forming the column to a mist which is a first cleaning fluid and returning said column to the detergent solution generating unit to form further detergent solution in the detergent solution generating unit;

wherein the first cleaning fluid in the form of a mist atomized in the order of microns by the ultrasonic vibrating unit permeates into and remains in a food debris stuck on the to-be-cleaned item for a predetermined period of time; and a second operation step of removing the food debris on the to-be-cleaned item by using a second cleaning fluid, wherein the second operation step is to be performed after the first operation step.

2. The method of claim 1, wherein the detergent solution is obtained by dissolving at least one of an alkaline agent, a surfactant, an enzyme and a bleaching agent in the wash water.

3. The method of claim 1, wherein the second cleaning fluid is obtained by dissolving at least one of an alkaline agent, a surfactant, an enzyme and a bleaching agent in water.

4. The method of claim 2, wherein the second cleaning fluid is obtained by dissolving at least one of an alkaline agent, a surfactant, an enzyme and a bleaching agent in water.

5. The method of claim 1, wherein the first cleaning fluid is allowed to permeate into the food debris on the to-be-cleaned item after being heated by a heating unit.

6. The method of claim 2, wherein the first cleaning fluid is allowed to permeate into the food debris on the to-be-cleaned item after being heated by a heating unit.

7. The cleaning method of claim 1, wherein the ultrasonic vibrating unit includes a sealed vessel which contains therein a fluid medium and has an interface in contact with the detergent solution; and an ultrasonic vibrator installed at a bottom of the sealed vessel such that the fluid medium rests on a vibrating surface of the ultrasonic vibrator, and wherein the first operation step supplies the wash water such that a water level of the wash water is maintained above the interface and generates vibration from the ultrasonic vibrator to be transmitted to the wash water via the fluid medium and the interface such that the water column is generated from the detergent solution to thereby be atomized.

8. The cleaning method of claim 7, the interface is inclined so that air bubbles gathered at an inner wall of the interface are directed to move along the inclined interface to thereby stay away from a center of the vibration.

9. The cleaning method of claim 5, wherein the heating unit heats the wash water to facilitate dissolution of detergent.

10. The cleaning method of claim 1, wherein a return passage is formed downward from a top portion of the detergent loading cover and has a cross section formed in an one-side opened rectangular shape, and the water column flows through the return passage.

* * * * *